US005427845A

United States Patent [19]

Sawyer et al.

[11] Patent Number: 5,427,845

[45] Date of Patent: Jun. 27, 1995

[54] CRIMPED MELT-SPUN COPOLYMER FILAMENTS

[75] Inventors: Lawrence H. Sawyer, Roswell; Christopher C. Creagan, Marietta; John C. Faison, Cumming, all of Ga.

[73] Assignee: Kimberly-Clark Corporation, Neenah, Wis.

[21] Appl. No.: 535,798

[22] Filed: Jun. 8, 1990

[51] Int. Cl.[6] ..... B05D 5/00

[52] U.S. Cl. ..... 428/288; 428/369; 428/371; 428/903; 19/296; 19/66.1; 264/168

[58] Field of Search ..... 428/369, 371, 288, 903; 19/296, 66.1; 264/168

[56] References Cited

U.S. PATENT DOCUMENTS

| | | | |
|---|---|---|---|
| 3,322,607 | 5/1967 | Jung | 161/67 |
| 3,480,709 | 11/1969 | Jacob et al. | 264/237 |
| 3,577,498 | 5/1971 | Matsuo et al. | 264/168 |
| 3,914,497 | 10/1975 | Kanehira et al. | 428/288 |
| 3,929,542 | 12/1975 | Gehrig et al. | 156/167 |
| 4,209,563 | 6/1980 | Sisson | 428/288 |
| 4,211,819 | 7/1980 | Kunimune et al. | 428/374 |
| 4,412,016 | 10/1983 | Fukui et al. | 523/206 |
| 4,775,722 | 10/1988 | Kobayashi et al. | 525/227 |
| 4,783,231 | 11/1988 | Raley | 156/167 |
| 4,818,597 | 4/1989 | DaPonte et al. | 428/284 |

OTHER PUBLICATIONS

Japanese Abstract-92-100963 Apr. 1992.

*Primary Examiner*—George F. Lesmes
*Assistant Examiner*—C. W. Raimund
*Attorney, Agent, or Firm*—Karl V. Sidor

[57] ABSTRACT

Melt-spun filaments having a highly crimped configuration which is imparted by differential cooling, nonwoven webs of the crimped melt-spun filaments, and a process of forming a nonwoven web of the crimped filaments are disclosed. The filaments are formed from a random copolymer of propylene and ethylene or an alpha-olefin co-monomer having at least 4 carbon atoms which provides an enhanced response to filament crimping by differential cooling. The random copolymer may contain from about 0.5 to about 10 percent, by weight, of ethylene or an alpha-olefin co-monomer having at least 4 carbon atoms; and from about 99.5 to about 90 percent, by weight, propylene. The alpha-olefin co-monomer having at least 4 carbon atoms may be 1-butene, 4-methyl-1-pentene, 1-hexene, or 1-octene. When differentially cooled and collected into a nonwoven web, the crimped filaments provide a nonwoven web having a combination of softness, low density, high bulk and porosity which are associated with desirable fluid transfer characteristics.

20 Claims, 4 Drawing Sheets

CRIMPED MELT-SPUN COPOLYMER FILAMENTS

FIELD OF THE INVENTION

This invention relates generally to in-situ crimped melt-spun filaments and nonwoven webs of such filaments.

BACKGROUND OF THE INVENTION

Absorbent articles such as diapers;, incontinence products and feminine care products have generally involved some combination of an impervious backing material, an absorbent material, and a cover or liner material. The cover layer or liner layer should have desirable fluid-handling characteristics, yet be soft and comfortable for the wearer. In the past, a variety of cover materials have been used such as, for example, perforated films, netting materials and nonwoven webs. Although perforated films and netting generally have desirable fluid-handling characteristics, they have the disadvantage of feeling clammy and uncomfortable next to the skin. Conventionally formed nonwoven webs of melt-spun filaments have acceptable fluid handling characteristics and more desirable tactile characteristics than nettings or perforated films. The melt-spun filaments of such nonwoven webs can be crimped to further improve softness, visual and tactile aesthetics as well as fluid handling performance. More particularly, the decreased bulk and openness provided by crimped filaments is associated with improved fluid acquisition and transfer.

Crimped filaments may be made by several methods. Mechanical crimping techniques or bi-component or multi-component filaments are expensive and require special manufacturing processes. Fiber crimping caused by differential cooling of an un-solidified melt-spun filament is known. For example, U.S. Pat. No. 4,783,231 to Raley describes a nonwoven web containing fibers that have been differentially cooled to impart a crimped configuration. The fibers can be thermally relaxed to partially decrimp the fibers which increases the loft and decreases the density of the nonwoven web. According to that patent the fibers may be made of any material generally satisfactory for formation of fibers, such as, for example, polypropylene, polyethylene, polyester, nylon, rayon, polyurethane, cellulose and compatible blends of those materials.

However, melt-spun fibers of conventional homopolymers and polymer blends generally must be fine, low denier fibers in order to respond effectively to differential cooling. Nonwoven webs of such crimped, fine melt-spun filaments generally appear to have relatively poor fluid acquisition and transfer characteristics and may be difficult to process. Thicker filaments may be produced, however, they do not crimp very well and typically form nonwoven webs that have undesirable stiffness and tactile properties.

Crimped copolymer filaments are disclosed in, for example, U.S. Pat. No. 3,929,542 to Gehrig et al. That patent discloses nonwoven webs of helically crimped filaments formed from polyethylene and copolymers of ethylene with 1-olefins, vinyl esters, acrylic esters, and vinyl chloride. The proportion of co-monomer in the total ethylene copolymer may be up to about 30% by weight. It is also disclosed that crimped nonwoven webs may be formed of polypropylene and polybutene, copolymers of propylene and 1-butene with each other and with other 1-olefins. The proportion of co-monomer in the total propylene and/or 1-butene copolymer may be up to about 15% by weight. According to Gehrig et al., the crimped filaments are formed by extruding the molten polymer through a spinnerette and then directing cooling air against bundles of newly formed filaments. The filaments then enter a crimping device and are crimped by periodically applying and removing one or more annular or cylindrical vortices of a gaseous medium with partial flow-off and replenishment of the vortex or vortices. Although partial one-sided cooling is disclosed as assisting the crimping of the filaments, Gehrig et al., teaches that over-cooling is undesirable since the filaments can no longer be shaped in the crimping zone unless hot gas or steam is introduced. After leaving the crimping zone, Gehrig et al. discloses that the bundles of filaments pass through moveable elements (e.g., flexible tubes) to mouthpieces which are moved in a prescribed swinging motion so that the filaments are laid down in a perfect or imperfect trochoid pattern.

Thus, there exists a need for a cover material having a combination of softness and the high bulk/low density associated with desirable fluid transfer characteristics that can be produced easily and economically utilizing conventional filament forming apparatus without specialized crimping and/or web forming devices.

DEFINITIONS

As used herein, the term "melt-spun filaments" refers to small diameter fibers and filaments which are formed by extruding a molten thermoplastic material as filaments from a plurality of fine, usually circular, capillaries of a spinnerette with the diameter of the extruded filaments then being rapidly reduced as by, for example, eductive drawing or other well-known melt-spinning mechanisms. The production of nonwoven webs of melt-spun filaments such as, for example, spunbond filaments is illustrated in patents such as, for example, in U.S. Pat. No. 4,340,563 to Appel et al., and U.S. Pat. No. 3,692,618 to Dorschner et al. The disclosures of those patents are hereby incorporated by reference.

As used herein, the term "melt flow rate" refers to the amount of material under a pressure or load that flows through an orifice at a given temperature over a measured period of time. The melt flow rate is expressed in units of weight divided by time (i.e., grams/10 minutes). The melt flow rate was determined by measuring the weight of a polymer under a 2.160 kg load that flowed through an orifice diameter of 2.0955±0.0051 mm during a measured time period such as, for example, 10 minutes at a specified temperature such as, for example, 230° C. as determined in accordance with ASTM Test Method D1238-82, "Standard Test Method for Flow Rates of Thermoplastic By Extrusion Plastometer," using a Model VE 4-78 Extrusion Plastometer (Tinius Olsen Testing Machine Co., Willow Grove, Pa.).

As used herein,, the term "polydispersity index" refers ratio of the weight average molecular weight of a polymer divided by the number average molecular weight of a polymer. The polydispersity index (PDI) may be expressed by the following equation:

$$PDI \approx [(\Sigma N_x M_x^2)/(\Sigma N_x M_x)]/[(\Sigma N_x M_x)/\Sigma N_x]$$

where the summations are over all the different sizes of polymer molecules from $x=1$ to $x=\infty$ and $N_x$ is the number of moles whose weight is $M_x$. As used herein, the term "differential cooling" refers to cooling a portion of a melt-spun filament as it is extruded from a spinning die tip to produce a temperature gradient across the cross-section of the filament. Differential cooling may be carried out by directing a stream of cold fluid transversely against melt spun filaments as they are drawn from the filament forming apparatus.

As used herein, the term "nonwoven web" means a web having a structure of individual fibers or threads which are interlaid, but not in an identifiable, repeating manner. Nonwoven webs have been, in the past, formed by a variety of processes such as, for example, melt-blowing processes, spunbonding processes and bonded carded web processes.

As used herein, the term "consisting essentially of" does not exclude the presence of additional materials which do not significantly affect the desired characteristics of a given composition or product. Exemplary materials of this sort would include, without limitation, pigments, antioxidants, stabilizers, surfactants, waxes, flow promoters, particulates and materials added to enhance processability of the composition.

SUMMARY OF THE INVENTION

Accordingly, the above-described needs are addressed by the present invention which provides a nonwoven web of crimped melt-spun filaments that has a desirable bending modulus, low density, high bulk and good porosity associated with desirable fluid transfer characteristics. The individual melt-spun filaments of the nonwoven web have a highly crimped configuration without the need for specialized crimping and/or web forming devices, or filaments with a specialized bi-component or multi-component structure.

The highly crimped configuration is imparted to the melt-spun filaments because they are formed from an extrudable thermoplastic random copolymer having an enhanced response to differential cooling. Melt-spun random copolymer filaments with even a relatively large median fiber size can be differentially cooled into a highly crimped configuration when the filaments are formed from the random copolymer within the ranges recited by the present invention. The crimped random copolymer filaments may be collected into a nonwoven web.

According to the present invention, the melt-spun filaments are formed from an extrudable thermoplastic resin which is a random copolymer of about 99.5 to about 90 percent, by weight, propylene and about 0.5 to about 10 percent, by weight, ethylene or an alpha-olefin co-monomer having at least 4 carbon atoms. Random copolymers containing from about 1 to about 5 percent, by weight, of ethylene or an alpha-olefin co-monomer having at least 4 carbon atoms; and from about 99 to about 95 percent, by weight, propylene have been found to work well in the present invention. The alpha-olefin co-monomer having at least 4 carbon atoms may be 1-butene, 4-methyl-1-pentene, 1-hexene, or 1-octene.

For example, the random copolymer may contain from about 99.5 to about 90 percent, by weight, propylene and from about 0.5 to about 10 percent, by weight, ethylene and have a melt flow rate from about 12 to about 75 grams/10 minutes (Condition 230/2.16) and a polydispersity index from about 2.2 to about 4.

The highly crimped configuration of the melt-spun filaments may be produced by differentially cooling the filament with a cold fluid as they are drawn from the filament forming apparatus to produce an asymmetric, differential contraction which causes crimps, twists, and curls in the filaments. In order to enhance the effect of differential cooling the melt-spun random copolymer filaments may have a non-circular cross section, such as for example, a bi-lobal, triangular, or similar noncircular cross section. Highly crimped filaments are obtained without specialized crimping devices and/or bi-component or multi-component filament construction.

In one aspect of the present invention, an approximately 0.8 ounce per square yard (osy) nonwoven web of the above described melt-spun filaments has an average fiber size of about 5 denier and a Frazier porosity of at least about 1000 $ft^3/sec/ft^2$, a density of less than about 0.050 grams per cubic centimeter, and a bending modulus characterized by Handle-O-Meter test results of less than about 6 grams and cup crush test results of less than about 32 grams.

According to the present invention, the nonwoven web of melt-spun filaments has low density, high bulk, good porosity, and large filament size which is associated with good fluid transfer properties. The nonwoven web also provides desirable softness. Such nonwoven webs of crimped filaments are useful as a cover or liner material in absorbent structures or articles. Multiple layers of the nonwoven web of the present invention may be joined to form a multi-layer laminate. Such a multi-layer material may be used as a high basis weight cover or liner material or as padding, packing, or insulation material. Similarly, one or more layers of the nonwoven web of the present invention may be joined to other materials such as, for example, nonwoven melt-blown webs, textiles, films and the like to form a composite material. Those composites may be used, for example, as cover, insulation, or packing material.

In yet another aspect of the present invention, a nonwoven fibrous web of highly crimped random copolymer filaments may be formed by a process which includes the steps of: forming filaments from an extrudable copolymer composition having from about 0.5 to about 10 percent by weight of ethylene or an alpha-olefin co-monomer having at least 4 carbon atoms; and from about 99.5 to about 90 percent by weight propylene; differentially cooling the copolymer filaments; and then collecting the copolymer filaments as a coherent nonwoven web. The process for forming the nonwoven web may also include a step in which the nonwoven web is heated to relax or partially decrimp the copolymer filaments to further increase the loft and bulk of the nonwoven web.

DETAILED DESCRIPTION OF THE INVENTION

Figure 1:
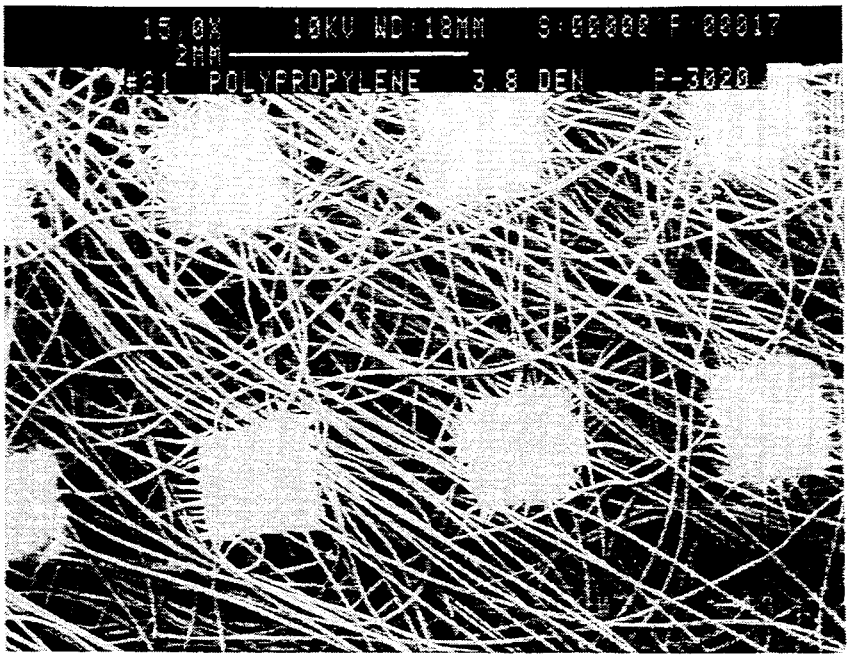
FIG. 1 is a photomicrograph of an exemplary nonwoven web of differentially cooled polypropylene homopolymer melt-spun filaments.

The present invention provides a nonwoven web having improved softness and fluid transfer characteristics. The nonwoven web contains melt-spun filaments that have been differentially cooled to produce a highly crimped configuration. The melt-spun filaments are formed from an extrudable thermoplastic resin which was discovered to have an enhanced response to differential cooling which allows melt-spun filaments to be produced without specialized crimping and/or filament forming devices or bi-component or multi-component filament construction.

The thermoplastic resin is a random copolymer of propylene and ethylene or an alpha-olefin co-monomer having at least 4 carbon atoms. The alpha-olefin co-monomer having at least 4 carbon atoms may be, for example, 1-butene, 4-methyl-1-pentene, 1-hexene, and 1-octene. The random copolymer contains from about 0.5 to about 10 percent, by weight, of ethylene or an alpha-olefin co-monomer having at least 4 carbon atoms; and from about 99.5 to about 90 percent, by weight, propylene. For example, the random copolymer may contain from about 1 to about 5 percent, by weight, ethylene; and from about 99 to about 95 percent, by weight, propylene.

The random copolymer should be a melt grade polymer with a narrow molecular weight distribution and controlled rheology suitable for fiber or filament forming. Such a melt grade random copolymer may be characterized as having a melt flow of about 12 to about 75 grams/10 minutes (Condition 230/2.16). For example, the random copolymer may have a melt flow of about 20 to about 60 grams/10 minutes (Condition 230/2.16). The random copolymer may desirably have a melt flow of about 35 to about 45 grams/10 minutes (Condition 230/2.16). The molecular weight distribution of the random copolymer may by characterized by a polydispersity index from about 2.0 to about 5.0. For example, the random copolymer may have a polydispersity index ranging from about 2.2 to about 4.0.

One useful random copolymer contains from about 3 to about 4 percent, by weight, ethylene and from about 96 to about 97 percent, by weight, propylene and may be characterized as having a melt flow of from about 35 to about 45 grams/10 minutes (Condition 230/2.16) and a polydispersity index of from about 3.0 to about 4.0. For example, the random copolymer may contain about 3.2 percent, by weight, ethylene and 96.8 percent, by weight, propylene and may be characterized as having a melt flow of about 40 grams/10 minutes (Condition 230/2.16) and a polydispersity index of about 3.5 to about 4.0.

The random copolymer may contain additives such as, for example, pigments, processing aids, and/or surface active agents to impart specific physical characteristics or improve processing. For example, a pigment such as titanium dioxide ($TiO_2$) may be added to improve color and opacity of filaments melt-spun from the copolymer.

As is described subsequently, the highly crimped configuration of the copolymer filaments is produced by differentially cooling the melt-spun filaments as they are drawn from the filament forming apparatus to produce an asymmetric, differential contraction which imparts crimps, twists, and curls in the filaments.

Figure 2:
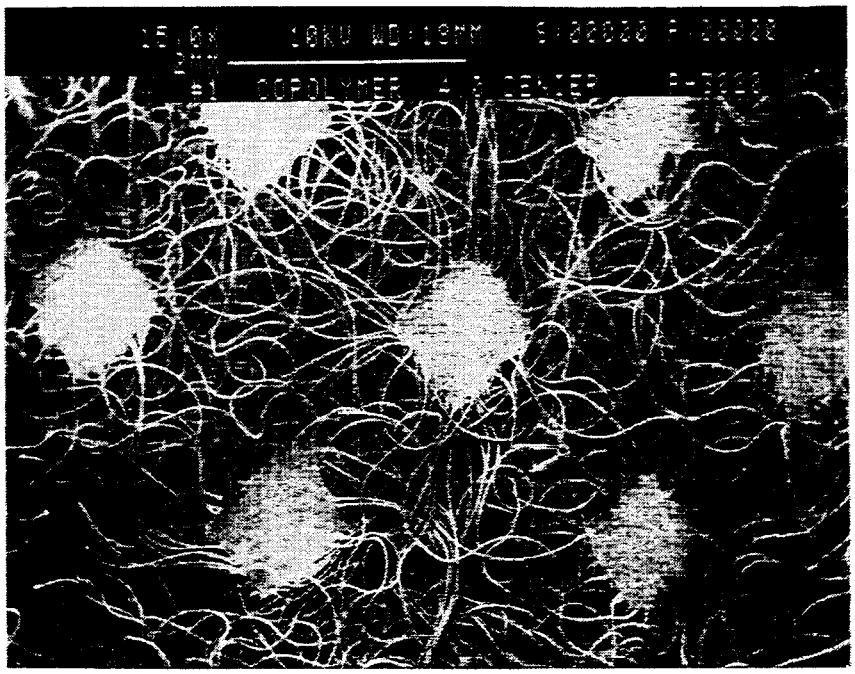
FIG. 2 is a photomicrograph of an exemplary nonwoven web of differentially cooled random ethylene-propylene copolymer melt-spun filaments.

It has been discovered that melt-spun filaments of the random copolymer within the range recited by the present invention have an enhanced response to differential cooling. This enhanced response may be seen, for example, when comparing differentially cooled random copolymer filaments to differentially cooled filaments formed from conventional polypropylene homopolymers. For example, FIG. 1 is a microphotograph of an exemplary nonwoven web of differentially cooled melt-spun polypropylene filaments at a magnification of 15×. The filaments and nonwoven web were formed under the conditions given in Examples 1–7 and described subsequently. FIG. 2 is a microphotograph of an exemplary nonwoven web of differentially cooled melt-spun random ethylene-propylene copolymer (i.e., 3.2 percent, by weight, ethylene and 96.8 percent, by weight, propylene) filaments at a magnification of 15×. The filaments and nonwoven web were formed under the conditions given in Example 8–14 with the same equipment used to make the nonwoven web of FIG. 1. As can be readily seen from the microphotographs, the filaments of FIG. 1 have less crimp, curl and twist than the filaments of FIG. 2. The difference in the filaments appears to produce a difference in the physical properties of the respective nonwoven webs. Several properties were measured for each webs produced in the Examples and the results are reported in Tables 1 and 2. Because of the enhanced response of the melt-spun random copolymer filaments to differential cooling, filaments having even a relatively large median fiber size can be differentially cooled into a highly crimped configuration.

Figure 3:
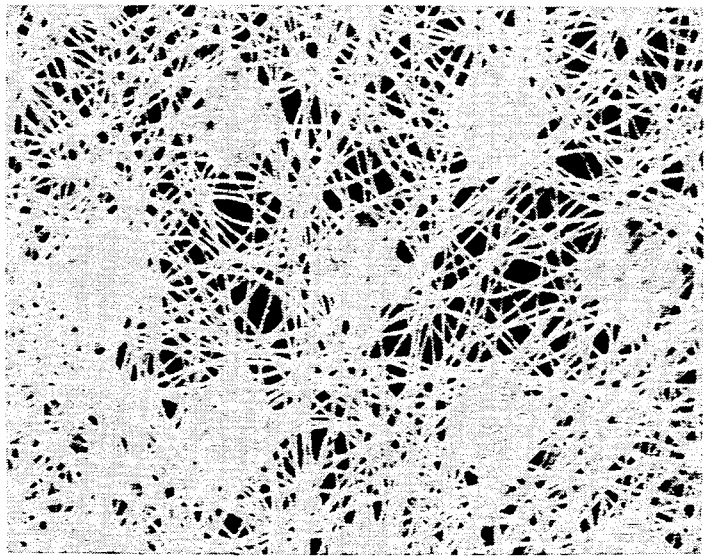
FIG. 3 is a photomicrograph of an exemplary nonwoven web of random ethylene-propylene copolymer melt-spun filaments which were formed utilizing conventional cooling techniques.

The highly crimped filament configuration is not noticeable when the random copolymer is melt-spun into filaments utilizing conventional cooling techniques which do not produce sufficient temperature gradients across the filaments which are believed to produce significant twist, curl and crimp in the random copolymer filaments. For example, FIG. 3 is a microphotograph (15× magnification) of an exemplary nonwoven web of melt-spun random copolymer filaments formed utilizing conventional cooling techniques. The filaments and nonwoven web were formed from the same random copolymer used to make the filaments of FIG. 2 utilizing the conditions given in Example 15. The filaments of FIG. 3 display significantly less crimp, twist and curl than the filaments of FIG. 2.

Although the inventors should not be held to a particular theory of operation, it is believed that the presence of a co-monomer in a semicrystalline olefinic polymer such as polypropylene modifies the crystallization behavior, solid state morphology, and the material properties of the polymer. When small amounts of the co-monomer are randomly incorporated into the polymer, the co-monomer acts as a chain defect or imperfection during polymer crystallization. Since increasing the probability of chain defects in a crystallizable system is believed to reduce the overall rate of crystallization and result in less stable crystalline domains, the net result is a copolymer that exhibits a lower dynamic crystallization temperature, a smaller degree of crystallization and a reduced melting temperature when compared to the homopolymer under the same conditions. It is believed that when polymers having such a random copolymer crystallization behavior are melt-spun into filaments and are subjected to differential cooling, the melt-spun filaments exhibit an enhanced twisting, crimping, and curling. The enhanced twisting, crimping and curling is not noticeable when the melt-spun random copolymer filaments are subjected only to conventional cooling techniques.

The effect of a co-monomer randomly incorporated into a polyolefin chain will vary with the mass of the individual co-monomer molecule and the spatial separation of the individual co-monomer units in the polyolefin chain. The presence of a single unit of co-monomer such as, for example, ethylene has less of an effect on the crystallization of a polyolefin chain such as, for example, polypropylene than a single unit of 1-butene. However, two ethylene units closely spaced on a polypropylene chain would have more effect than a single 1-butene unit. In general, the effect of co-monomer mass on the crystallization of polypropylene increases with increasing molecular weight (e.g., ethylene<1-butene<4-methyl-1-pentene< 1-hexene<1-octene). Co-monomer molecules larger than $C_8$ appear to have limited additional effect.

As noted above, filaments formed from the above-described random copolymers (e.g. ethylene-propylene random copolymers) provide several advantages when compared with filaments made with conventional homopolymers (e.g. propylene) or polymer blends (e.g., polyethylene-polypropylene blends). For example, the random copolymer filaments provide: greater twist, curl and crimp when subjected to differential cooling; lower modulus and greater toughness (i.e., softer, more flexible filaments that can dissipate greater energy); and more complete thermal bonding when used in a thermally bonded nonwoven web.

Figure 4:
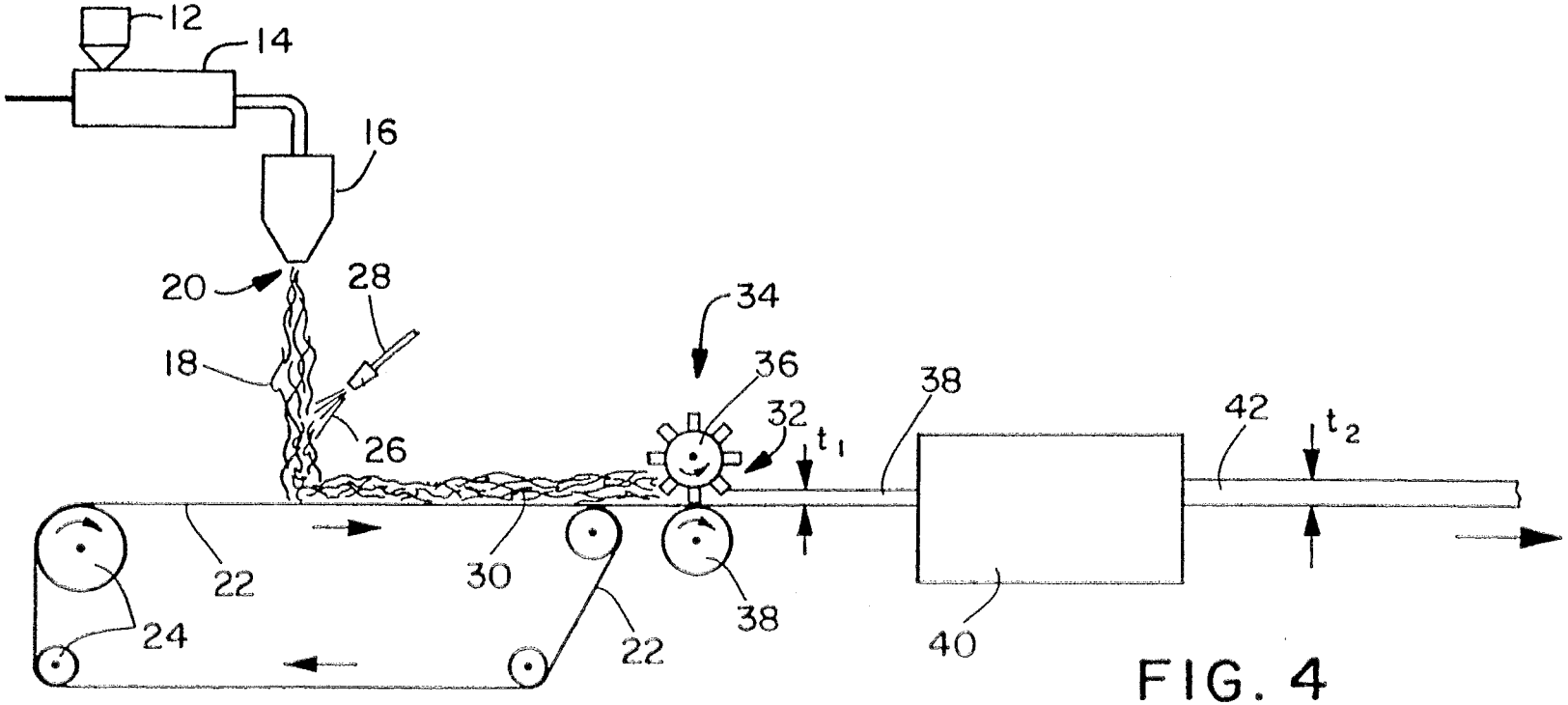
FIG. 4 is a representation of an exemplary process for producing a nonwoven web of differentially cooled melt-spun filaments.

Referring to the drawings where like reference numerals represent like materials or process steps and, in part, to FIG. 4, there is schematically illustrated at 10 a method for producing a nonwoven web of melt-spun copolymer filaments (e.g., spunbonded filaments) according to the present invention. In forming the nonwoven web of the present invention pellets or chips, etc.(-not shown) of a copolymer material are introduced into a pellet hopper 12 of an extruder 14.

The extruder 14 has an extrusion screw (not shown) which is driven by a conventional drive motor (not shown). As the copolymer advances through the extruder 14, due to rotation of the extrusion screw by the drive motor, it is progressively heated to a molten state. Heating of the copolymer to the molten state may be accomplished in a plurality of discrete steps with its temperature being gradually elevated as it advances through discrete heating zones of the extruder 14 toward an extrusion die 16. The die 16 may be yet another heating zone where the temperature of the copolymer is maintained at an elevated level for extrusion. The temperature which will be required to heat the copolymer to a molten state will vary somewhat depending upon which type of copolymer is utilized. For example, a random block copolymer containing about 3.2 percent, by weight, ethylene and about 96.8 percent, by weight, propylene may be extruded at a temperature of from about 440° F. to about 500° F. Heating of the various zones of the extruder 14 and the extrusion die 16 may be achieved by any of a variety of conventional heating arrangements (not shown).

The filaments of molten copolymer are initially formed and discharged in a stream 18 from spaced-apart filament forming means 20. The forming means 20 may be any suitable filament forming means such as spinnerettes, die orifices, or similar equipment associated with melt-spinning processes such as, for example, the spunbonding process. Exemplary spunbonding processes as disclosed in previously referenced U.S. Pat. Nos. 3,692,618 and 4,340,563. The spun filaments discharged from the forming means may fall by gravity, be drawn, or fluid-entrained to deposit on a foraminous forming surface 22 supported in turn on roller 24 driven by a drive means (not shown).

A stream of cold fluid 26 is discharged through a duct or nozzle 28, and transversely directed against the filament stream 18 to differentially cool a portion of each filament before they are deposited on the forming surface.

The cold fluid may be a gas such as, for example, air or nitrogen. Other suitable gases may also be used. The temperature of the fluid should be below the temperature of the filaments impinged upon by the fluid stream so as to create a differential cooling of the filaments. The fluid should be about 45° F. to about 120° F. (i.e., at least about 300 degrees Fahrenheit cooler than the copolymer exiting the filament forming means). For example, the temperature of the cold fluid should be about 60° F. when a random copolymer of about 3.2 percent, by weight, ethylene and 96.8 percent, by weight, propylene is extruded at a temperature of about 450° F. If the stream of cold fluid 26 is stream of cold air, the stream of cold air may have a flow rate from about 0.4 to about 2.0 $ft^3$ of air per gram of polymer exiting the filament forming means.

By directing the flow of cold fluid 26 past the filaments in a direction generally transverse to the movement of the filament stream 18, the sides of the filaments which are windward or upstream of the cold fluid flow path are cooled more than the sides of the filaments which are leeward or downstream of the cold fluid flow path. Differential cooling may be practiced as disclosed in U.S. Pat. No. 4,783,321 to Raley, the entire contents of which are incorporated herein by reference.

Figure 5:
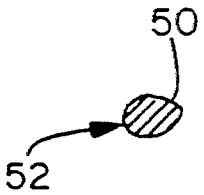
FIG. 5 is a cross-sectional view of an exemplary noncircular melt-spun filament.
Figure 6:
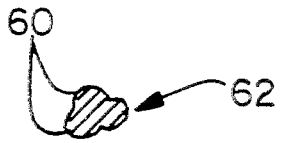
FIG. 6 is a cross-sectional view of an exemplary trilobal melt-spun filament.

It is possible to enhance differential cooling of filaments by their inherent geometries. A filament or fiber with a non-circular or asymmetric cross section typically cools faster in those portions where there is a smaller internal area and a larger outer surface area. The rate of cooling which is affected by fiber shape may be enhanced by impingement of a cold fluid so that a temperature gradient is created across the cross-section of the fiber. For example, FIGS. 5 and 6 show non-circular cross sections of filaments which cool rapidly at the protruding portions 50 and 60 of each fiber 52 and 62, respectively. As shown in FIG. 6, the filament 62 may have a tri-lobal cross section. The filament may have other non-circular cross sections, such as for example, a bi-lobal or a triangular cross section.

The differential cooling of the filaments in the filament stream provides a crimped fiber configuration to such filaments. That is, as a result of the transverse temperature gradient the filaments curl and/or kink along their lengths to create a filament which is more crimped or twisted than before being cooled. As illustrated in FIG. 4, the differentially cooled filaments are collected on the forming surface to provide a web of differentially cooled, crimped copolymer filaments. The web 30 separates from the forming surface 22, and is directed into, and through nip 32 of a patterned roller arrangement 34. The patterned roll 36 is used for thermal pattern bonding of the web 30. The smooth anvil roll 38, together with the patterned roll 36 defines a thermal pattern bonding nip. The patterned roll 36 is heated to a suitable bonding temperature by heating means (not shown) and is rotated by conventional drive means (also not shown), so that when the web 30 passes through the nip the patterned roller arrangement, a series of thermal pattern bonds is formed. As a result of the thermal pattern bonding, the web 30 of filaments becomes a pattern bonded web 38 of enhanced stability.

The pattern bonded web 38 may be heated to partially decrimp the filaments to increase the loft and bulkiness of the web. However, this step is optional since the random copolymer filaments have an enhanced response to differential cooling which results in nonwoven webs having high loft and bulk without a thermal relaxation step. Thermal relaxation of the nonwoven web may be accomplished as disclosed in previously referenced U.S. Pat. No. 4,783,231.

As shown in FIG. 4, the pattern bonded web 38 having a thickness $t_1$ passes into a thermal relaxation zone 40, where the web 38 is heated so that the filaments at least partially decrimp and thereby increase the loft of the web and its bulk, while decreasing its density. The thermally relaxed web 18 exits from the thermal relaxation zone 40 at a thickness $t_2$, where it may then be passed to other process and/or treatment steps, such as joining with an absorbent body to form a composite which then may be formed into discrete articles for use as disposable diapers, sanitary napkins and the like.

The thermal relaxation zone 40 is maintained at an elevated temperature which causes at least partial decrimping of the filaments in the web causing an increase in the loft (thickness) of the web and its bulk, and a corresponding decrease in the web's density. As is shown in FIG. 1, the thermally relaxed thickness of the web 42 is measured by the dimension $t_2$, which is greater than the corresponding thickness dimension $t_1$ of the differentially cooled web 38 prior to such thermal relaxation treatment.

The thermal relaxation zone 40 may utilize any heating means which are effective to raise the temperature of the filaments in the web 38 to the desired level. For example, such heating means may be radiant heat lamps or the flow of a hot gas or fluid through the housing which defines the thermal relaxation zone 40.

While the thermal relaxation of the differentially cooled fibers may be conducted before bonding the filaments to form a bonded nonwoven web, the thermal relaxation step may also be performed after the filaments have been bonded in the web.

Figure 7:
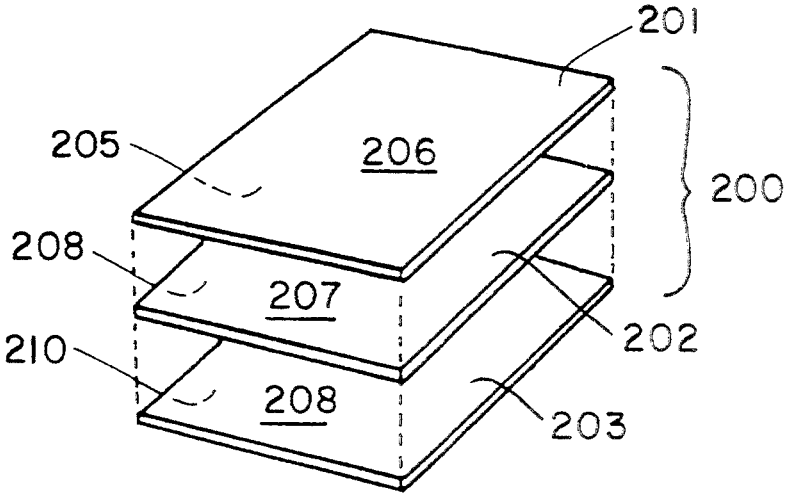
FIG. 7 is a representation of an exemplary absorbent structure incorporating a nonwoven web of differentially cooled random ethylene-propylene copolymer melt-spun filaments.

FIG. 7 is an exploded perspective view of an absorbent structure according to the present invention. The structure 200, shown here as a multi-layer composite suitable for use in a disposable diaper, feminine pad or personal care product contains three layers, a top layer 201, an intermediate layer 202, and a bottom layer 203. The top layer 201 is a nonwoven web of crimped melt-spun filaments according to the present invention. The top layer 201 may function as a liner for a disposable diaper, or a transfer layer and/or cover layer for a feminine care pad or personal care product. The upper surface 206 of the top layer 201 is the portion of the absorbent structure 200 intended to contact the skin of a wearer. The lower surface 205 of the top layer 201 is superposed on the intermediate layer 202 which is an absorbent body of a material such as, for example, an air-felt or cellulosic batting. The intermediate layer 202 has an upper surface 207 in contact witch the lower surface 205 of the top layer 201. The intermediate layer 202 also has a lower surface 208 superposed on a fluid-impervious bottom layer 203. The bottom layer 203 has an upper surface 209 which is in contact with the bottom surface 208 of the intermediate layer 202. The bottom surface 210 of the fluid-impervious layer 203 provides the outer surface for the absorbent structure 200. In more conventional terms, the liner layer 201 is a topsheet, the fluid-impervious bottom layer 203 is a backsheet, and the intermediate layer 202 is an absorbent layer. Each layer may be separately formed and joined to the other layers in a conventional manner. The layers may be cut or shaped before or after assembly to provide a particular personal care product configuration.

When the layers are assembled to form a product such as, for example, a feminine pad, the top layer 201 of a nonwoven web according to the present invention provides the advantages of improved fluid transport, softness and comfort, improved masking or covering, and reduced fluid retention in the top layer (i.e., more fluid is effectively transferred to the absorbent intermediate layer 202).

According to one aspect of the present invention, the crimped filaments may be collected into a nonwoven web which is soft, bulky, and has good fluid transfer characteristics. The softness of the nonwoven web can be attributed to the flexibility and suppleness provided by the crimped configuration of the differentially cooled melt-spun filaments and the softness of filaments themselves since they are produced from the above-described random copolymers.

For example, the nonwoven webs of the present invention have a measurable softness (i.e., bending modulus) which may be characterized by Handle-O-Meter test results of less than about 6 grams. The Handle-O-Meter tests were performed on a Handle-O-Meter Model No 211-5 available from the Thwing-Albert Instrument Company. The tests were conducted in accordance with INDA Standard Test IST 90.0-75(R82) with the following exceptions: the sample size was 4"×4" instead of 8"×8; and five (5) specimens were tested instead of two (2).

Likewise, the nonwoven webs of the present invention have measurable softness which may be characterized by cup crush test results of less than about 32 grams. The cup crush test evaluates fabric stiffness by measuring the peak load required for a 4.5 cm diameter hemispherically shaped foot to crush a 9"×9" piece of fabric shaped into an approximately 6.5 cm diameter by 6.5 cm tall inverted cup while the cup shaped fabric was surrounded by an approximately 6.5 cm diameter cylinder to maintain a uniform deformation of the cup shaped fabric. The foot and the cup were aligned to avoid contact between the cup walls and the foot which could affect the peak load. The peak load was measured while the foot was descending at a rate of about 0.25 inches per second (15 inches per minute) utilizing a Model FTD-G-500 load cell (500 gram range) available from the Schaevitz Company, Tennsauken, N.J.

The nonwoven fibrous webs of the present invention have increased bulk, openness and low density which are associated with improved fluid transfer characteristics. For example, the density of the web may be from about 0.01 to about 0.05 grams per cubic centimeter.

The density of the nonwoven web was determined by dividing the web's basis weight by the its thickness. The basis weight of the nonwoven web was determined in accordance with Federal Test Method 5041, Standard No. 191A. The thickness of the nonwoven web was measured with an Ames Thickness Tester Model 3223 available from the B. C. Ames Company of Waltham, Mass. The thickness tester was equipped with a 5"×5" (25 inch$^2$) foot. The height of each 4"×4" sample was measured at a load of 182±5 grams.

Because of the improved softness and crimp of the individual copolymer filaments, a nonwoven web of relatively large denier melt-spun filaments may be used without creating undesirable stiffness. For example, the nonwoven webs of the present invention having the level of softness previously described may have a median fiber or filament size of at least about 4 denier. For example, the median filament size may range from about 4 denier to about 12 denier. Median fiber or filament size is an expression of the median denier (weight in grams per 9000 meters of filament) of a melt-spun filament or fiber. Fiber or filament size is determined by measuring the diameter of filaments in the nonwoven web using a microscope at about 400× magnification using conventional techniques. The diameter measurement is converted to denier by the following equation:

$$\text{Denier}=(\pi * D^2/4)*\text{density}*(9*10^5)$$

where D is diameter in centimeters and density is polymer density expressed in g/cm$^3$.

Nonwoven webs of crimped filaments having a median fiber size in the above described denier range have better fluid (e.g., gas, liquid, etc.) transfer properties than filaments of lower denier. For example, the nonwoven webs of the present invention have a Frazier porosity of at least about 1000 ft$^3$/sec/ft$^2$. The Frazier porosity was determined utilizing a Frazier Air Permeability Tester available from the Frazier Precision Instrument Company. The Frazier porosity was determined in accordance with Federal Test Method 5450, Standard No. 191A, except that the sample size was 8"×8" instead of 7"×7.

The combination of softness, porosity, and low density provided by the nonwoven web of the present invention has several important advantages over previous nonwoven fibrous materials because those previous materials had difficulty providing a balance of softness, fluid transfer properties and cost. The nonwoven web of the present invention may be used as an economical yet soft cover/liner layer or transfer layer with desirable fluid transfer characteristics. The webs are made utilizing economical melt-spinning processes and have low density and high bulk so that less polymer is required for a particular volume of nonwoven web. As noted above, the nonwoven webs have desirable softness because of the high modulus random copolymer filaments and because of the highly crimped configuration of the filaments. Also as noted above, the nonwoven webs have good fluid transfer properties because of their bulky, low density structure, porosity, and their relatively large median filament size.

Several of the nonwoven webs of the present invention may be combined into a multilayer material. A multilayer arrangement can provide a bulky, low density fabric with good fluid transfer characteristics and softness. Such a material would be useful as a transfer layer or separation layer in an absorbent structure or article. Other uses include padding, packing material, insulation, and lining material.

One or more of the nonwoven webs of the present invention may be joined with other materials to form a composite material. For example, one or more textured webs may be joined with a fibrous layer such as a bonded carded web, a web of meltblown fibers, a wet-laid web, an air-laid web, or a web of conventional spunbond material. Where the composite material includes a layer of meltblown fibers, the meltblown fibers may include meltblown microfibers. Such a material would be useful as an outer cover layer for a personal care product or as a padding, packing, insulation, wrapping, or lining material.

The layers of the composite material may be joined by thermal bonding, needle-punching, hydraulic entangling, adhesives, ultrasonic bonding and laser welding. Useful hydraulic entangling techniques are disclosed in U.S. Pat. No. 4,879,170 to Radwanski, et al., the contents of which are incorporated by reference in their entirety. Useful thermal bonding techniques are disclosed in, for example, U.S Pat. No. 4,720,415 to Vander Wielen, et al., the contents of which are incorporated by reference in their entirety.

EXAMPLES

Melt-spun filaments of Examples 1–14 were made using a spunbonding process similar to that described in previously referenced U.S. Pat. Nos. 3,692,618 and 4,340,563. The spunbonding apparatus was equipped with a cold air stream which was configured to direct cold air against the melt-spun filaments as they were drawn from the melt-spinning die to differentially cool the filaments. The cold air stream was directed in a path substantially perpendicular to the path of the melt-spun filaments. The cold air stream had a volumetric flow rate of about 45 cubic feet per minute per inch width of the air duct (at a rate of about 0.7 ft$^3$ air per gram of polymer) and a temperature of about 50° F. The differentially cooled filaments were collected into a nonwoven web which was measured to determine the following characteristics: basis weight, bulk, Handle-O-Meter, cup crush, Frazier porosity, and median fiber size.

The peak load and elongation were also measured for each nonwoven web. These properties were measured utilizing an Instron Model 1122 Universal Test Instrument in accordance with Method 5100 of Federal Test Method Standard No. 191A.

Peak load refers to the maximum load or force encountered while elongating the sample to a specified elongation or to break. Peak Load is expressed in units of force (lbs$_f$).

"Elongation" or "percent elongation" refers to a ratio determined by measuring the difference between a nonwoven web's initial unextended length and its extended length in a particular dimension and dividing that difference by the nonwoven webs initial unextended length in that same dimension. That value is multiplied by 100 percent when elongation is expressed as a percent. The elongation was measured when the material was stretched to about its breaking point.

EXAMPLES 1–7

Examples 1–7 illustrate nonwoven webs of spunbonded, differentially cooled filaments formed from a random copolymer of about 3.2 percent, by weight, ethylene and about 96.8 percent, by weight, propylene. The random copolymer had a melt flow of about 40 grams/10 minutes (Condition 230/2.16) and a polydispersity index of about 3.5 to about 4.0.

The copolymer was extruded in a temperature range of about 440°–460° F. into filaments that were differentially cooled using the cold air stream as described above. The filaments were collected into nonwoven webs each having a basis weight of about 0.8 ounces per square yard. The webs were thermally bonded utilizing a patterned bond roller providing a bond surface area of approximately 15 percent. The bonding temperature ranged from about 270–280° F. and the bonding pressure was about 450–500 pounds per linear inch (pli). Physical characteristics of the nonwoven webs from Examples 1–7 were measured using the previously described tests and are reported in Table 1.

TABLE 1

| | | Nonwoven Webs of Crimped Ethylene-Propylene Random Copolymer Melt-Spun Filaments | | | | | | | | | | |
|---|---|---|---|---|---|---|---|---|---|---|---|---|
| | (oz/yd²) Basis | (Inch) | (lbs) Peak Load | | (%) Elongation | | (g/cm³) Avg | (grams) Handle-O-Meter | | (grams) CUP | (ft³/sec/ft²) Frazier | |
| Example | Weight | Bulk | MD | CD | MD | CD | Density | MD | CD | Crush | Porosity | Denier |
| 1 x | 0.91 | 0.029 | 12.4 | 8.3 | 100.7 | 150.8 | 0.042 | 4.4 | 2.0 | 18 | 1177.5 | 4.0 |
| s | 0.023 | 0.0013 | 1.33 | 0.77 | 11.31 | 19.22 | | 0.64 | 0.50 | 0.03 | 412.23 | 0.39 |
| 2 x | 0.83 | 0.030 | 9.4 | 5.9 | 94.3 | 159.6 | 0.037 | 4.6 | 2.1 | 19 | 1272.2 | 5.3 |
| s | 0.017 | 0.0023 | 1.59 | 1.03 | 16.63 | 13.86 | | 1.08 | 1.03 | 0.02 | 72.02 | 0.71 |
| 3 X | 0.75 | 0.029 | 7.5 | 5.0 | 83.3 | 122.8 | 0.035 | 5.0 | 2.8 | 27 | 1342.4 | 5.2 |
| S | 0.024 | 0.0035 | 0.68 | 0.88 | 22.88 | 10.48 | | 0.62 | 0.66 | 0.04 | 59.83 | 0.42 |
| 4 X | 0.79 | 0.022 | 9.0 | 5.8 | 80.5 | 101.5 | 0.048 | 5.4 | 3.5 | 21 | 1499.6 | 6.9 |
| S | 0.041 | 0.0011 | 1.0 | 1.09 | 10.96 | 12.46 | | 1.40 | 1.60 | 0.03 | 54.36 | 0.54 |
| 5 X | 0.83 | 0.025 | 12.1 | 7.5 | 92.7 | 139.3 | 0.044 | 5.3 | 2.1 | 25 | 720.5 | 3.4 |
| S | 0.031 | 0.0012 | 1.01 | 0.81 | 7.42 | 9.41 | | 0.83 | 0.56 | 0.04 | 40.65 | 6.37 |
| 6 X | 0.79 | 0.021 | 9.8 | 6.4 | 86.0 | 117.8 | 0.050 | 6.7 | 3.8 | 32 | 925.9 | 3.9 |
| S | 0.033 | 0.0015 | 1.58 | 0.95 | 16.20 | 20.72 | | 1.12 | 1.00 | 0.05 | 31.07 | 0.56 |
| 7 X | 0.78 | 0.022 | 7.1 | 3.1 | 87.3 | 95.6 | 0.047 | 5.2 | 3.1 | 22 | 1487.5 | 6.9 |
| S | 0.050 | 0.0014 | 0.61 | 0.52 | 9.69 | 11.39 | | 1.08 | 1.49 | 0.03 | 20.49 | 0.54 |

TABLE 2

| | | Nonwoven Webs of Crimped Polypropylene Melt-Spun Filaments | | | | | | | | | | |
|---|---|---|---|---|---|---|---|---|---|---|---|---|
| | (oz/yd²) Basis | (Inch) | (lbs) Peak Load | | (%) Elongation | | (g/cm³) Avg | (grams) Handle-O-Meter | | (grams) CUP | (ft³/sec/ft²) Frazier | |
| Example | Weight | Bulk | MD | CD | MD | CD | Density | MD | CD | Crush | Porosity | Denier |
| 8 X | 0.68 | 0.016 | 8.8 | 6.5 | 48.8 | 91.8 | 0.064 | 13.1 | 4.4 | 45 | 1114.8 | 4.3 |
| S | 0.031 | 0.0000 | 1.73 | 0.77 | 10.67 | 9.61 | | 1.78 | 1.52 | 5 | 40.59 | 1.50 |
| 9 X | 0.73 | 0.015 | 11.2 | 5.6 | 56.8 | 99.1 | 0.068 | 14.8 | 3.9 | 35 | 1046.0 | 3.8 |
| S | 0.017 | 0.0017 | 1.30 | 0.68 | 8.06 | 13.99 | | 2.52 | 1.47 | 5 | 41.72 | 0.00 |
| 10 X | 0.75 | 0.015 | 20.5 | 7.2 | 58.2 | 141.4 | 0.065 | 13.7 | 1.6 | 45 | 602.7 | 3.8 |
| S | 0.011 | 0.0004 | 1.88 | 0.61 | 5.59 | 8.96 | | 1.49 | 0.46 | 4 | 27.93 | 0.00 |
| 11 X | 0.77 | 0.016 | 13.5 | 7.0 | 62.2 | 128.7 | 0.085 | 12.1 | 3.3 | 33 | 915.6 | 3.3 |
| S | 0.018 | 0.0020 | 1.27 | 0.73 | 10.60 | 7.78 | | 1.34 | 0.91 | 5 | 37.08 | 0.65 |
| 12 X | 0.76 | 0.015 | 12.2 | 7.7 | 50.9 | 92.0 | 0.065 | 12.1 | 5.1 | 50 | 971.9 | 3.8 |
| S | 0.023 | 0.0009 | 1.64 | 1.26 | 7.02 | 11.40 | | 1.12 | 2.39 | 9 | 39.36 | 0.00 |
| 13 X | 0.68 | 0.015 | 8.9 | 5.8 | 55.2 | 96.7 | 0.057 | 9.3 | 2.8 | 41 | 1117.2 | 5.4 |
| S | 0.032 | 0.0009 | 0.55 | 0.88 | 3.93 | 29.06 | | 1.10 | 1.00 | 10 | 70.14 | 0.67 |
| 14 X | 0.78 | 0.016 | 7.5 | 4.4 | 83.9 | 88.6 | 0.061 | 8.3 | 4.7 | 37 | 1164.9 | 12.5 |
| S | 0.045 | 0.0019 | 1.52 | 0.77 | 19.91 | 14.27 | | 1.84 | 1.57 | 3 | 113.27 | 3.43 |

EXAMPLES 8–14

The nonwoven webs of Examples 8–14 were formed from polypropylene using essentially the same process as for Examples 1–7. The polypropylene had a melt flow of about 35 grams/10 minutes (Condition 230/2.16) and was available from the Exxon Chemical Company under the trade designation PD-3445.

The polypropylene was extruded at temperatures ranging from 425°–460° F. into filaments that were differentially cooled with a cold air stream as described above. The filaments were collected into nonwoven webs each having a basis weight of about 0.8 ounces per square yard. The webs were thermally bonded utilizing a patterned bond roller providing a bond surface area of approximately 15 percent. The bonding temperature was about 280°–290° F. and the bonding pressure was about 450–500 pli. Some properties of the nonwoven webs of Examples 8–14 were measured using the previously described tests and are reported in Table 2.

As can be seen from the Tables, when compared to nonwoven webs of differentially cooled polypropylene filaments, the nonwoven webs of the present invention have improved bulk, greater elongation, better Handle-O-Meter and cup-crush test results, and improved Frazier porosity.

EXAMPLE 15

The random copolymer of Examples 1–7 containing about 3.2 percent, by weight, ethylene and about 96.8 percent, by weight, propylene (melt flow of about 40 grams/10 minutes (Condition 230/2.16) and polydispersity index of about 3.5 to about 4.0) was melt-spun into filaments using a spunbonding process similar to that described for examples 1–14 except that only conventional cooling techniques were used such as those described in, for example, U.S. Pat. Nos. 3,692,618 and 4,340,563.

The copolymer was extruded into filaments at a temperature range of about 440°–460° F. The conventional cooling techniques did not appear to produce a sufficient temperature gradient across the cross-sections of the filaments which is believed to cause significant crimp, twist and curl in the random copolymer filaments. The filaments were collected into a nonwoven web having a basis weight of about 0.8 ounces per square yard. The web was thermally bonded utilizing a patterned bond roller providing a bond surface area of approximately 15 percent. The bonding temperature ranged from about 270°–280° F. FIG. 3 shows a photomicrograph (15× magnification) of the nonwoven web of random copolymer filaments produced according to this example. The filaments of that nonwoven web (FIG. 3) have much less crimp, twist and curl compared to melt-spun filaments of the same random copolymer shown in the nonwoven web of FIG. 2 which was produced in accordance with Examples 1–7.

While the present invention has been described in connection with certain preferred embodiments, it is to be understood that the subject matter encompassed by way of the present invention is not to be limited to those specific embodiments. On the contrary, it is intended for the subject matter of the invention to include all alternatives, modifications and equivalents as can be included within the spirit and scope of the following claims.

What is claimed is:

1. A nonwoven web comprising at least one layer of highly crimped melt-spun filaments having a median size of at least about 4 denier, the filaments being formed of a random copolymer comprising:

from about 0.5 to about 10 percent, by weight, of a co-monomer selected from the group consisting of ethylene and alpha olefin co-monomers having at least 4 carbon atoms; and from about 99.5 to about 90 percent, by weight, propylene, wherein said copolymer filaments are differentially cooled to produce an asymmetric, differential contraction so that the filaments have a crimped configuration and the nonwoven web has a Frazier porosity of at least about 1000 $ft^3/sec/ft^2$ and a density from about 0.01 to about 0.05 grams per cubic centimeter.

2. The nonwoven web according to claim 1, wherein the melt-spun filaments are formed of a random copolymer comprising:

from about 1 to about 5 percent, by weight, of a co-monomer selected from the group consisting of ethylene and alpha olefin co-monomers having at least 4 carbon atoms; and from about 99 to about 95 percent, by weight, propylene,

3. The nonwoven web according to claim 1, wherein said alpha-olefin co-monomer having at least four carbon atoms is selected from the group consisting of 1-butene, 4-methyl-1-pentene, 1-hexene, and 1-octene.

4. The nonwoven web according to claim 1, wherein the web has a bending modulus characterized by Handle-O-Meter test results of less than about 6 grams, and cup crush test results of less than about 32 grams.

5. The nonwoven web according to claim 1, wherein said web comprises copolymer filaments that have a non-circular cross-section.

6. The nonwoven web according to claim 1, wherein said web comprises copolymer filaments that are formed by spunbonding.

7. The nonwoven web according to claim 1 wherein the random copolymer has a melt flow of about 12 to about 75 grams/10 minutes (Condition 230/2.16).

8. The nonwoven web according to claim 7 wherein the random copolymer has a melt of about 20 to about 60 grams/10 minutes (Condition 230/2.16).

9. The nonwoven web according to claim 8 wherein the random copolymer has a melt flow of about 35 to about 45 grams/10 minutes (Condition 230/2.16).

10. The nonwoven web according to claim 1 wherein the random copolymer has a molecular weight distribution characterized by a polydispersity index from about 2.0 to about 5.0.

11. The nonwoven web according to claim 10 wherein the random copolymer has a molecular weight distribution characterized by a polydispersity index from about 2.2 to about 4.0.

12. The nonwoven web according to claim 11 wherein the random copolymer has a molecular weight distribution characterized by a polydispersity index from about 3.0 to about 4.0.

13. The nonwoven web according to claim 1 wherein the random copolymer contains from about 3 to about 4 percent, by weight, ethylene and from about 96 to about 97 percent, by weight, propylene.

14. The nonwoven web according to claim 13 wherein the random copolymer contains about 3.2 percent, by weight, ethylene and 96.8 percent, by weight, propylene.

15. A multilayer material comprising:

at least one nonwoven web of melt-spun filaments according to claim 6, and at least one other layer.

16. The multilayer material according to claim 15 wherein the other layer is selected from the group consisting of a bonded carded web, a web of meltblown fibers, and a spunbonded web.

17. The multilayer material according to claim 16, wherein the web of meltblown fibers includes meltblown microfibers.

18. A process for forming a nonwoven web of crimped filaments having a median size of at least about 4 denier, said process comprising the steps of:

forming melt-spun filaments from an extrudable random copolymer comprising:

from about 0.5 to about 10 percent, by weight, of a co-monomer selected from the group consisting of ethylene and alpha olefin co-monomer having at least 4 carbon atoms; and from about 99.5 to about 90 percent, by weight, propylene, differentially cooling said melt-spun random copolymer filaments to impart a highly crimped configuration; and collecting said highly crimped melt-spun random copolymer filaments into a cohesive fibrous nonwoven web, wherein the nonwoven web has a Frazier porosity of at least about 1000 $ft^3/sec/ft^2$ and a density from about 0.01 to about 0.05 grams per cubic centimeter.

19. The process according to claim 18 further comprising the step of heating the cohesive nonwoven fibrous web of crimped copolymer fibers so that the crimped copolymer filaments become partially decrimped.

20. The process according to claim 18 wherein said cohesive fibrous nonwoven web of crimped filaments is bonded.

* * * * *

UNITED STATES PATENT AND TRADEMARK OFFICE

CERTIFICATE OF CORRECTION

PATENT NO. : 5,427,845

DATED : June 27, 1995

INVENTOR(S) : Lawrence H. Sawyer, Christopher C. Creagon

It is certified that error appears in the above-identified patent and that said Letters Patent is hereby corrected as shown below:

Column 3, line 1, "Mx. As used" should read --Mx. (new paragraph) As used..--.

Signed and Sealed this

Seventh Day of November, 1995

*Attest:*

Bruce Lehman

BRUCE LEHMAN

*Attesting Officer*

*Commissioner of Patents and Trademarks*